US006976826B2

(12) United States Patent
Roy et al.

(10) Patent No.: US 6,976,826 B2
(45) Date of Patent: Dec. 20, 2005

(54) TURBINE BLADE DIMPLE

(75) Inventors: François Roy, Carignan (CA); Dany Blais, Brossard (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 10/446,726

(22) Filed: May 29, 2003

(65) Prior Publication Data

US 2004/0241003 A1 Dec. 2, 2004

(51) Int. Cl.[7] ..... F01D 5/16

(52) U.S. Cl. ..... 416/1; 416/236 R; 416/500

(58) Field of Search ..... 416/234, 235, 416/236 R, 237, 1, 500

(56) References Cited

U.S. PATENT DOCUMENTS

| | | | | |
|---|---|---|---|---|
| 3,290,004 | A | 12/1966 | Ishibashi | |
| 3,802,046 | A | 4/1974 | Watchell et al. | |
| 4,274,806 | A | 6/1981 | Gallardo, Jr. | |
| 4,974,633 | A * | 12/1990 | Hickey | 137/561 R |
| 6,183,197 | B1 * | 2/2001 | Bunker et al. | 416/95 |
| 6,328,532 | B1 | 12/2001 | Hahnle | |
| 6,607,359 | B2 * | 8/2003 | von Flotow | 416/229 R |
| 2001/0033793 | A1 | 10/2001 | Lewis et al. | |

* cited by examiner

*Primary Examiner*—Ninh H. Nguyen
(74) *Attorney, Agent, or Firm*—Ogilvy Renault LLP

(57) ABSTRACT

A blade for mounting in an annular array about a rotary hub, the blade having: a blade root; an airfoil profile with a concave pressure side surface; a chord line extending between a leading edge and a trailing edge; and a blade tip, where the blade has a recess in the pressure side surface with an outer periphery disposed radially inwardly from the blade tip, and inwardly along the chord line from the leading edge and from the trailing edge.

15 Claims, 7 Drawing Sheets

TURBINE BLADE DIMPLE

TECHNICAL FIELD

The invention relates to a method of increasing the frequency of the natural vibration of a turbine blade, while reducing blade weight, maintaining performance and adding minimal or no cost, by forming a recess on the pressure side of the blade close to but not intersecting with the blade tip.

BACKGROUND OF THE ART

The invention relates to formation of a recess adjacent to a blade tip of blades mounted in turbines, compressor rotors, or fan blades, in a gas turbine engine.

In order to tune the blades to achieve dynamic benefits such as vibration stress reduction and weight reduction, the prior art has included recesses in the air foil surfaces of blades. The high rotary speeds and dynamic interaction with gas flow creates simultaneous need for weight reduction, maintenance of aerodynamic performance, measurement of blade creep growth but primarily for balancing dynamic vibratory effects.

For example, U.S. Pat. No. 4,265,023 provides a creep growth notch machined or cast adjacent to the tip of the air foil for measuring creep growth of the blade under stress. In order to increase the vibration mode frequency, prior art blades have included removal of material from the air foil extending to the blade tip.

A disadvantage of the prior art method is that the geometry of the tip of the blade is an important factor in determining the aerodynamic properties of the blade, the structural integrity of the blade and the maintenance of appropriate clearances with a surrounding shroud.

It is an object of the present invention to provide a means for increasing the natural frequency of the blade while maintaining the structural integrity, aerodynamic properties and castability of the blade.

Further objects of the invention will be apparent from review of the disclosure, drawings and description of the invention below.

DISCLOSURE OF THE INVENTION

The invention provides an apparatus and a method of increasing the frequency of the natural vibration of a turbine blade, while reducing blade weight, maintaining performance and adding no cost, by forming a recess on the pressure side of the blade close to but not intersecting with the blade tip.

A blade for an annular array of blades about a rotary hub, each blade having: an airfoil profile with a concave pressure side surface; a chord line extending between a leading edge and a trailing edge; and a blade tip, where each blade has a recess in the pressure side surface with an outer periphery disposed radially inwardly from the blade tip, and inwardly along the chord line from be integral with the rotor or may be separable therefrom.

The frequency of the natural vibration of the blade is increased using an aerodynamically shaped recess in the pressure side surface with an outer periphery disposed radially inwardly from the blade tip, and inwardly along the chord line from the leading edge and the trailing edge. It will be understood that the pressure side of the airfoil is the side exposed to a higher pressure due to the fluid flow passing over the airfoil The weight is reduced close to the blade tip maximizing the effect on vibration mode frequency, while having minimal effect on the blade rigidity and aerodynamic characteristics. Inclusion of the recess during casting of the blade adds no cost to the manufacturing process.

DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION OF PREFERRED EMBODIMENTS

Figure 1:
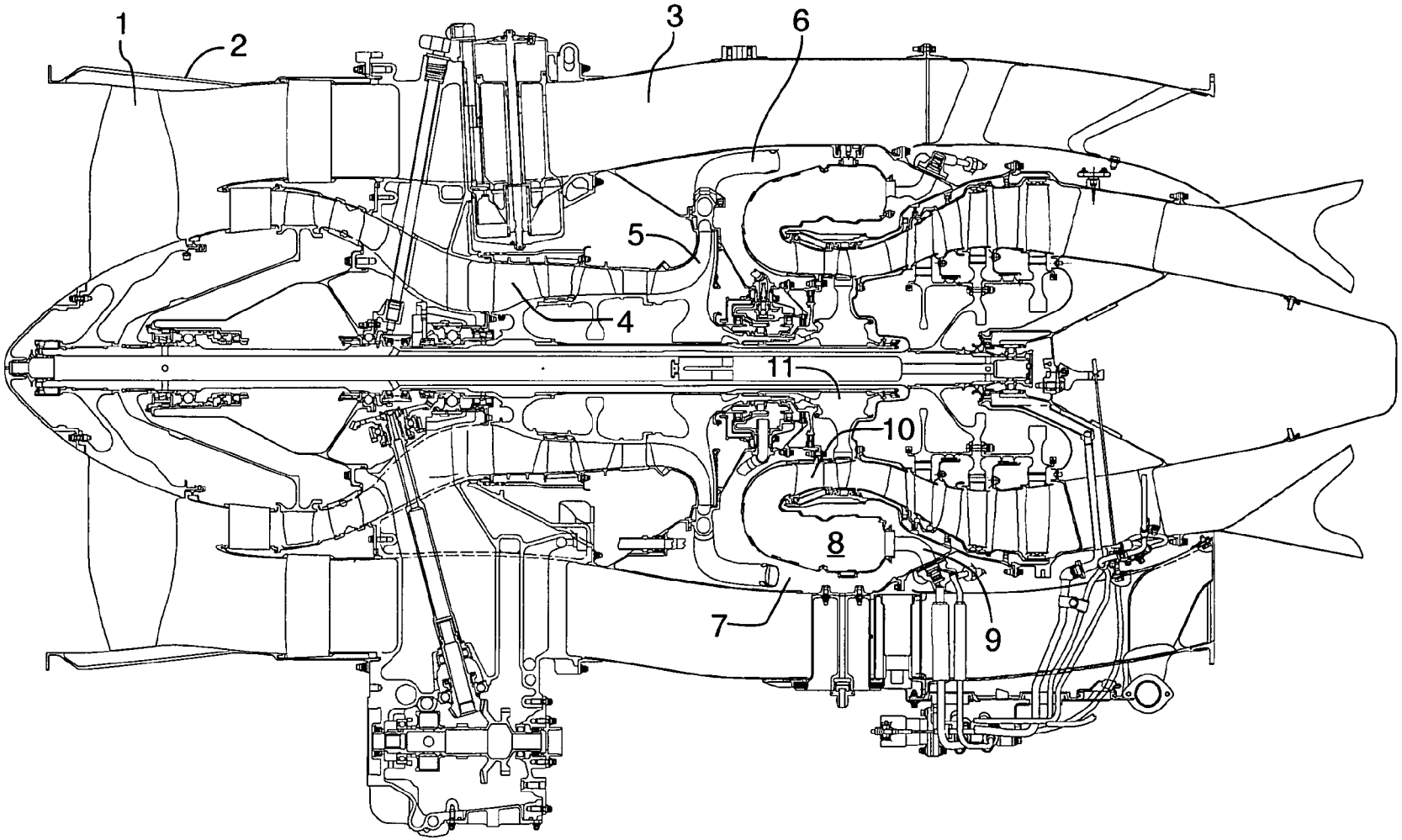
FIG. 1 is an axial cross-sectional view through a turbofan engine indicating the various blades to which the invention applies such as turbine blades, compressor blades or fan blades.

FIG. 1 shows an axial cross-section through a typical turbofan gas turbine engine. It will be understood however that the invention is applicable to any type of engine with a combustor and turbine section such as a turboshaft, a turboprop, auxiliary power unit, gas turbine engine or industrial gas turbine engine. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vanes 10 and turbines 11 before exiting the tail of the engine as exhaust. It will be understood that the foregoing description is intended to be exemplary of only one of many possible configurations of engine suitable for incorporation of the present invention.

Although the present description relates to use of the invention to increase the natural frequency of a turbine blade mounted in a turbine hub 11 of a gas turbine engine, it will be understood that the invention may be equally applied to the compressor section blades 4 or the fan blades 1 in appropriate circumstances. The invention also applies to integrally bladed rotors.

Figure 2:
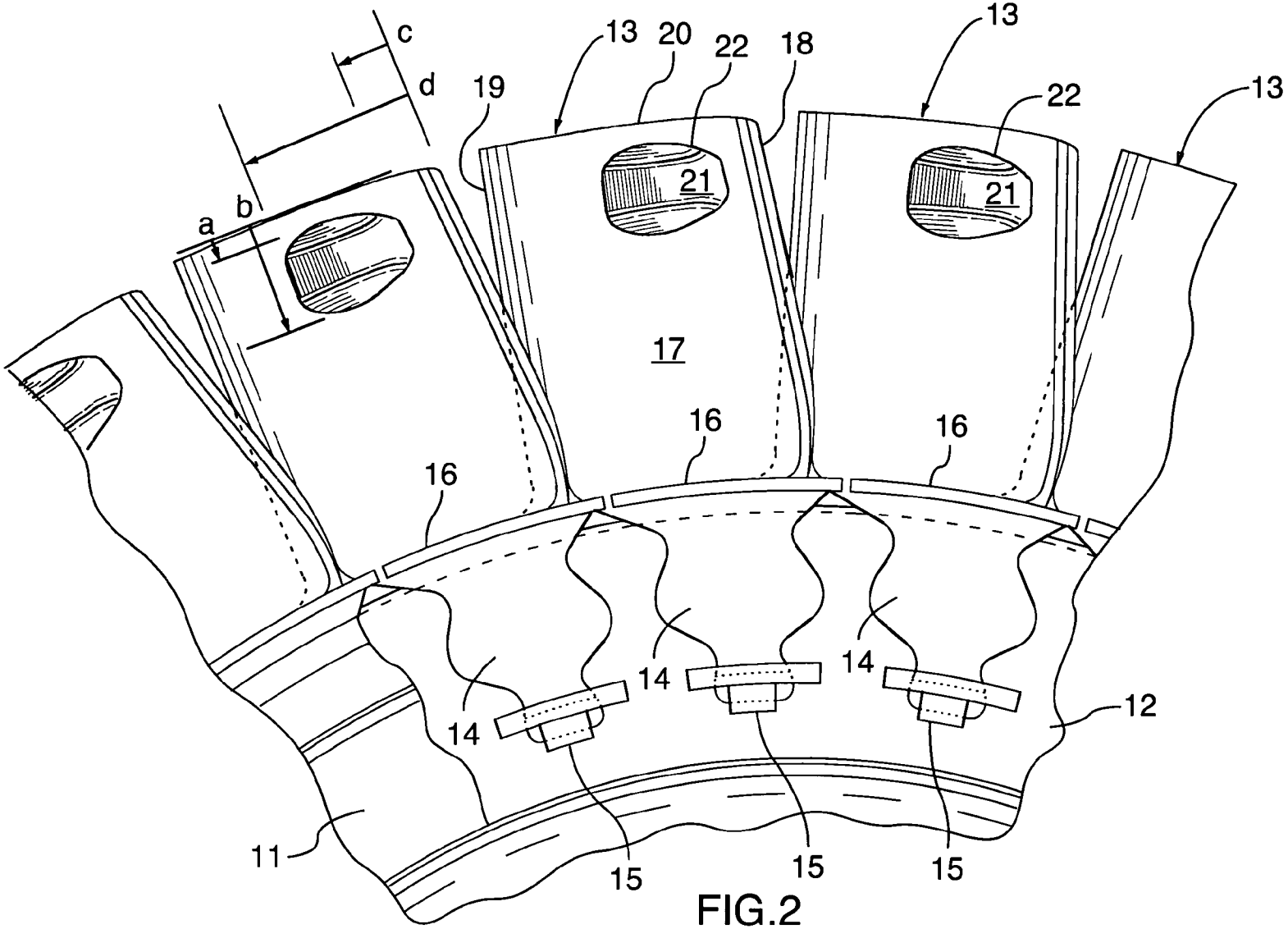
FIG. 2 is a radial partial sectional view showing a turbine hub with a circumferential array of turbine blades with blade roots mounted releasably in the outer periphery of the turbine hub.
Figure 3:
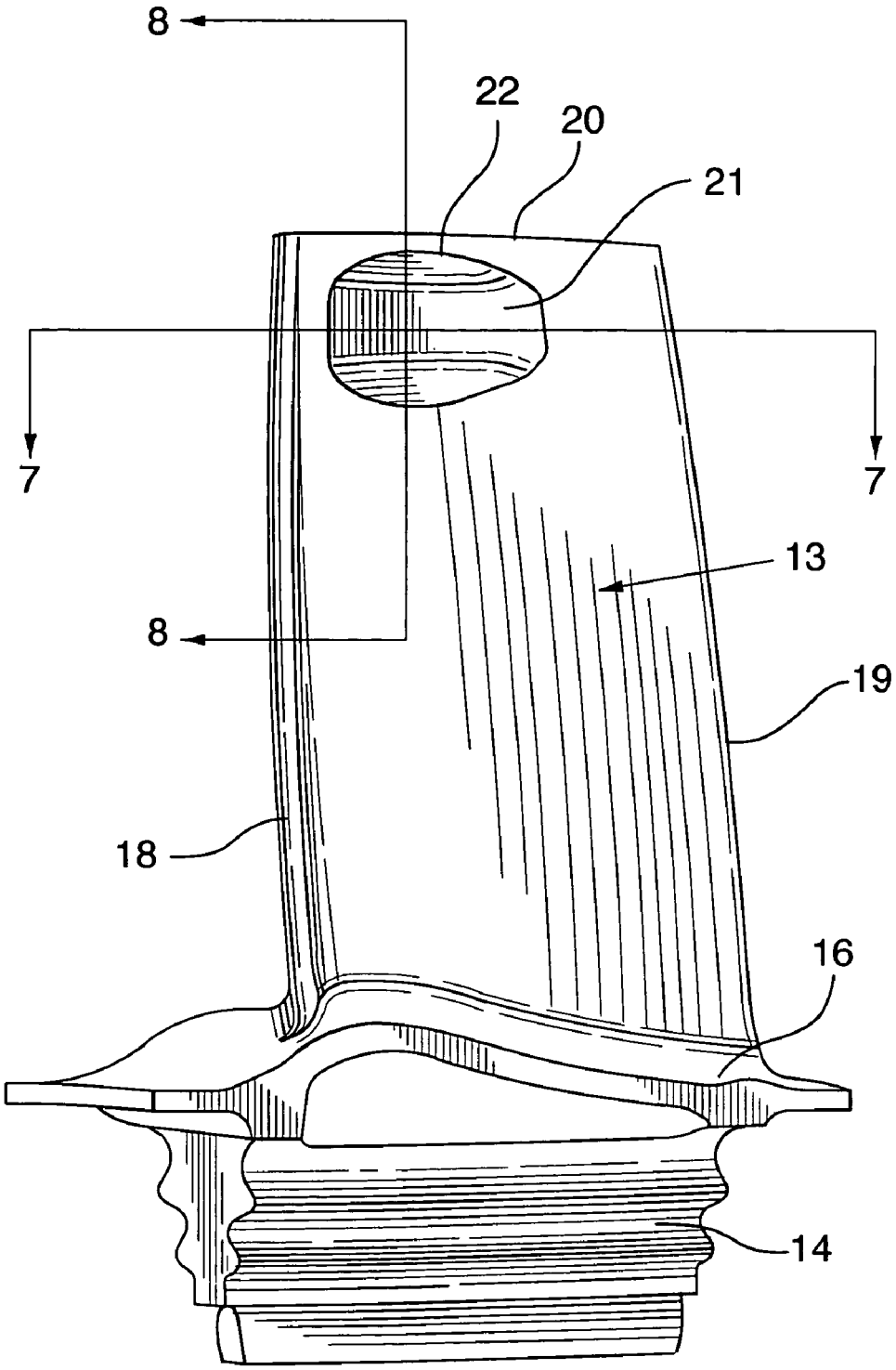
FIG. 3 is an isometric side view of a turbine blade in accordance with the invention showing a recess or dimple in the pressure side of the airfoil radially inward from the blade tip and rearward along the chord line of the leading edge.
Figure 4:
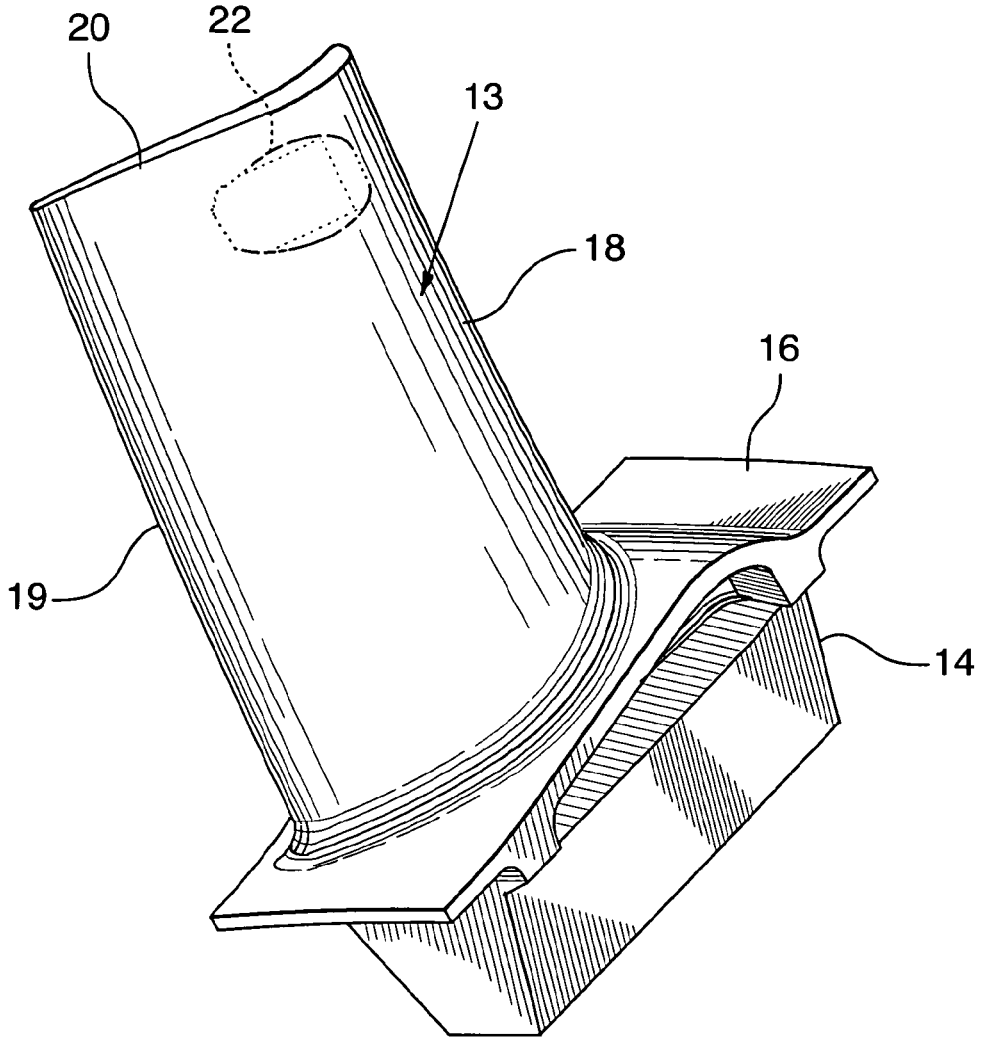
FIG. 4 is an isometric view of the opposite section side of the air foil shown in FIG. 3.
Figure 5:
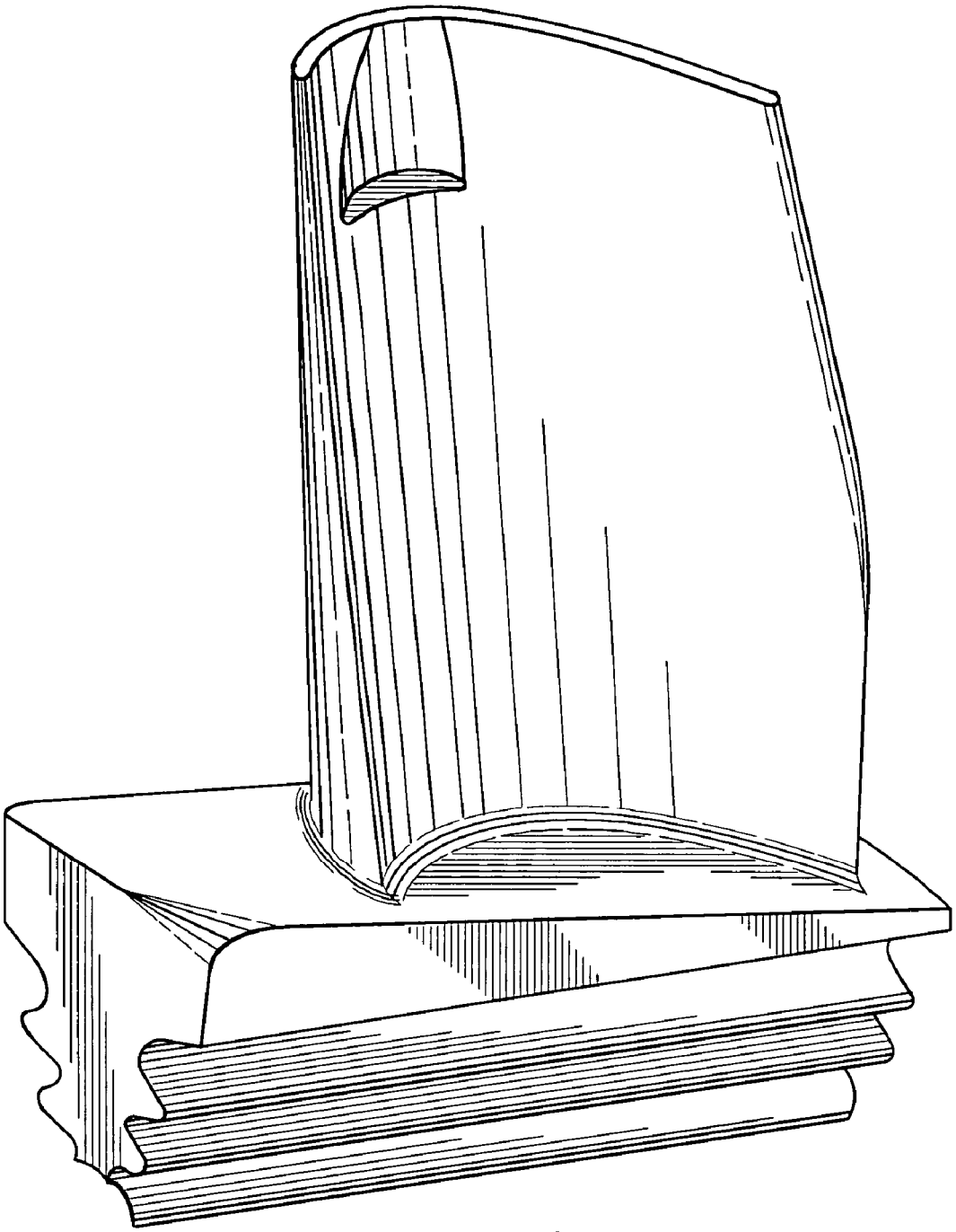
FIG.5 (Prior Art)
FIG. 5 is a like isometric view of a blade in accordance with the prior art showing a creep growth notch extending to the tip of the blade.
Figure 6:
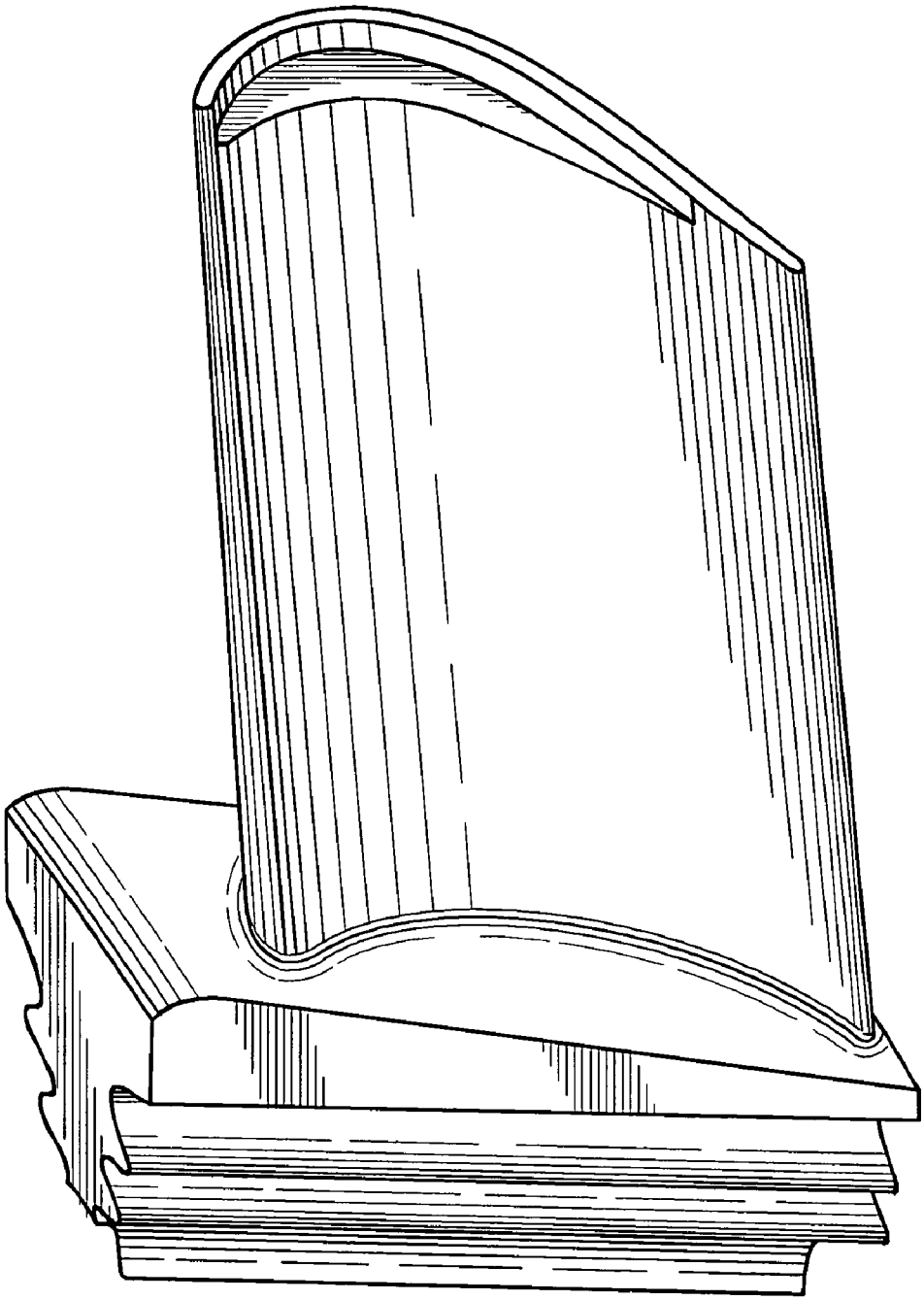
FIG.6 (Prior Art)
FIG. 6 is another like isometric view showing a weight reduction recess extending to the blade tip in accordance with the prior art.
Figure 7:
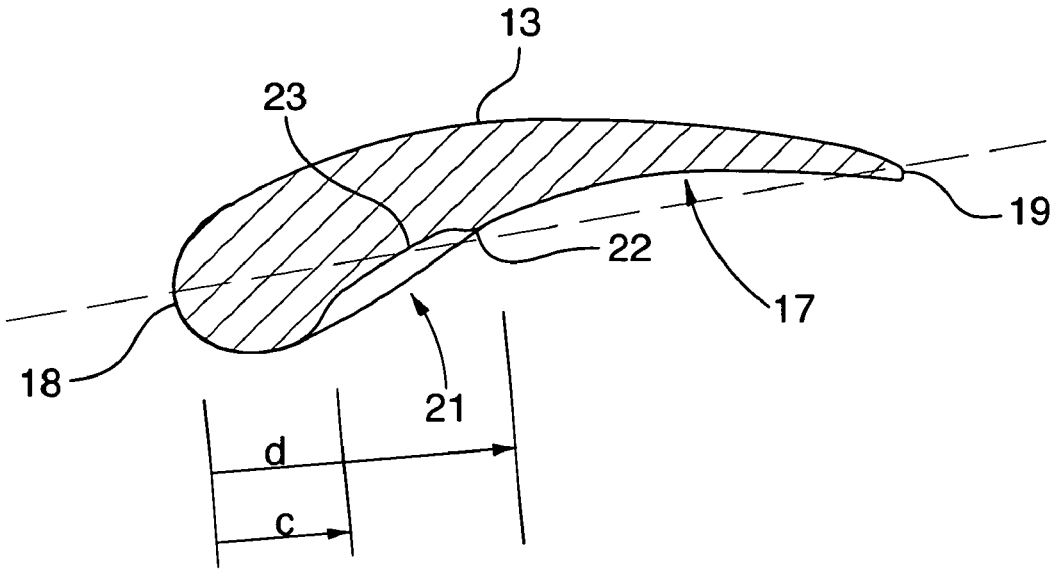
FIG. 7 is a sectional view along line 7—7 of FIG. 3.
Figure 8:
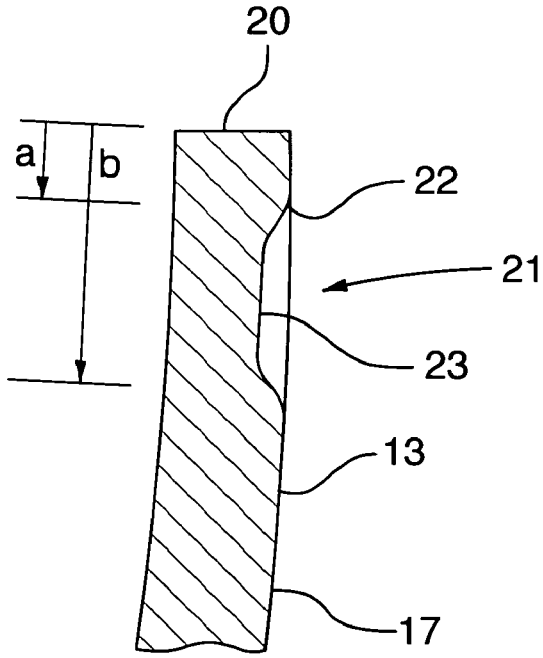
FIG. 8 is a sectional view along line 8—8 of FIG. 3.

As shown in FIG. 2, turbines 11 include a rotary hub 12 with an annular array of blades 13 each having a blade root 14 secured in a "fir tree" slot and held in place with the releasable fasteners 15. In contact with the annular gas path, the blade 13 has a blade platform 16 and an air foil profile with a concave pressure side surface 17, a leading edge 18, a trailing edge 19 and a blade tip 20. FIGS. 3 and 4 illustrate the geometry of an individual blade 13 utilizing the same numbering system.

In order to increase the natural frequency of the blade 13, and consequently tune the blade to optimize the dynamic effects and reduce over all weight, the invention includes a recess 21 or dimple in the pressure side surface 17 of the blade 13. The recess 21 in the embodiment illustrated is substantially rectangular with an outer periphery 22 that is disposed radially inwardly from the blade tip 20 and inward along the chord line from the leading edge 18 and from the trailing edge 19. The recess 21 has a base surface 23 that in this embodiment is substantially parallel to and spaced inwardly from the pressure side surface 17 and the periphery 22, base surface 23 and pressure side surface 17 preferably merge smoothly together to minimize any disturbance in the aerodynamic properties of the blade 13. Since blades 13 are generally cast, the method of forming the recess 21 adds little or no cost. However, the forming of the recess 21 can also be retrofit on existing blades 13 or newly manufactured blades 13 by machining which is also relatively simple. The method is most easily utilized with uncooled turbine blades 13, however if air channels and cooling path ways are cast within the blade 13, the method may be applied provided that structural integrity is maintained, no areas of the blade are rendered too thin and the castability of the assembly is maintained.

As will be recognized by those skilled in the art, the particular dimension and location of the recess 21 depend entirely upon the specific geometry of the blades 13 which it is applied. The amount of weight reduction created by the formation of the recess, the geometry of the periphery 22, the selective radius of transition between the recess 21, the outer periphery 22 and the pressure side surface 17 and the set back dimensions from the blade tip 20 and leading edge 18 are all parameters that are clearly affected by the specific geometry of the blade 13. Of course, reduction of any weight on the cantilever blade structure will have maximum effect the further the recess 21 is positioned from the blade root 14 and platform 16. To quantify these general principles, the radial height of the blade 13 can be defined as the distance between the blade platform 16 and the blade tip 20. A top portion of the periphery 22 may be disposed radially inward from the blade tip 20 a distance in a range of 2 to 20% of the height whereas the bottom portion of this substantially rectangular periphery 22 is disposed radially inward from the blade tip 20 a distance in the range of 10 to 50% of the height. In FIG. 2 these dimensions are illustrated using the letters "a" and "b" respectively.

The airfoil chord length of the blade 13 is defined between the leading edge 18 and trailing edge 19. A leading portion of the periphery 22 may be disposed inwardly from the leading edge a distance along the chord in the range of 10 to 40% of the total chord length and a trailing portion of the periphery 22 is disposed inwardly along the chord from a leading edge a distance in the range of 40 to 85% of the total chord length, as indicated in FIG. 2 with letters "c" and "d" respectively. Many variable parameters of the blade 13 will determine the precise configuration of any recess 21 however in general the ranges mentioned above will identify the most probable optimal area for positioning of the recess 21.

Therefore, the invention provides a simple low cost method of increasing the natural frequency of a blade 13 by including a recess 21 in the casting of the blade 13 to reduce weight in an optimal area adjacent to but not interfering with the blade tip 20. The recess 21 is a completely external feature on the high pressure side 17 of the blade 13 and is therefore exposed to the primary flow of gas through the annular gas path requiring accommodation for the effect on the aerodynamic features of the blade. The surfaces of the recess 21, base surface 23 and periphery 22 therefore preferably merge smoothly from the high pressure side 17 to minimize aerodynamic disturbance. In addition, the recess 21 does not extend to the tip 20 as in the prior art. Benefits to the structural integrity of the blade 13 and minimal disturbance to the air flow adjacent to the tip 20 result. The weight reduction due to the recess 21 may also improve the creep life of the blade 13 depending on the specific configuration; however this is not a focus of the present invention. Therefore, the invention provides a simple very low cost or minimal cost means to reduce weight and increase the natural frequency of the blade 13 while maintaining structural integrity and minimizing effects on the aerodynamic properties of the blade 13.

Although the above description relates to a specific preferred embodiment as presently contemplated by the inventors, it will be understood that the invention in its broad aspect includes mechanical and functional equivalents of the elements described herein.

We claim:

1. A gas turbine blade for mounting in an annular array about a rotary hub, the blade having: a blade root; an airfoil profile with a concave pressure side surface; a chord line extending between a leading edge and a trailing edge; and a blade tip, the blade comprising:

a single recess in the pressure side surface with an outer periphery disposed radially inwardly from the blade tip, and inwardly along the chord line from the leading edge and from the trailing edge, the recess being open during use of the gas turbine engine, wherein the recess has base surface substantially parallel to and spaced inwardly from the pressure side surface.

2. A blade according to claim 1 wherein the outer periphery is substantially rectangular.

3. A blade according to claim 1 wherein the blade has a radial height defined between the blade platform and the blade tip, and wherein a top portion of the outer periphery is disposed radially inwardly from the blade tip a distance in the range of 2–20 per cent of the height.

4. A blade according to claim 3 wherein a bottom portion of the outer periphery is disposed radially inwardly from the blade tip a distance in the range of 10–50 per cent of the height.

5. A blade according to claim 1 wherein the blade has a chord length defined between the leading edge and the trailing edge, and wherein a leading portion of the outer periphery is disposed inwardly along the chord line from the leading edge a distance in the range of 10–40 per cent of the chord length.

6. A blade according to claim 5 wherein a trailing portion of the outer periphery is disposed inwardly along the chord line from the leading edge a distance in the range of 40–85 per cent of the chord length.

7. A blade according to claim 1 wherein the blade is selected from the group consisting of: a turbine blade; a compressor blade; and a fan blade.

8. A gas turbine engine having a plurality of blades extending radially in an annular array from a rotor hub, each blade having a natural frequency and having: an airfoil profile with a concave pressure side surface; a chord line extending from a leading edge to a trailing edge; and a blade tip; and means for modifying the natural frequency of the airfoil comprising a hollow recess open to the pressure side surface with an outer periphery disposed radially inwardly from the blade tip, and inwardly along the chord line from the leading edge and from the trailing edge.

9. A method of increasing a natural frequency of a blade extending radially in an annular array from a rotor of a gas turbine engine, each blade having: an airfoil profile with a concave pressure side surface; a chord line extending from a leading edge to a trailing edge; and, a blade tip, the method comprising:

forming a recess open to the pressure side surface with an outer periphery disposed radially inwardly from the blade tip, and inwardly along the chord line from the leading edge and from the trailing edge, wherein the recess has base surface substantially parallel to and spaced inwardly from the pressure side surface; and operating the gas turbine with the recess in an empty condition.

10. A method according to claim 9 wherein the base surface, periphery and pressure side surface merge smoothly together.

11. A method according to claim 9 wherein the outer periphery is substantially rectangular.

12. A method according to claim 9 wherein the blade has a radial height defined between the blade platform and the blade tip, and wherein a top portion of the outer periphery is disposed radially inwardly from the blade tip a distance in the range of 2–20 per cent of the height.

13. A method according to claim 12 wherein a bottom portion of the outer periphery is disposed radially inwardly from the blade tip a distance in the range of 10–50 per cent of the height.

14. A method according to claim 9 wherein the blade has a chord length along the chord line defined between the leading edge and the trailing edge, and wherein a leading portion of the periphery is disposed inwardly along the chord line from the leading edge a distance in the range of 10–40 per cent of the chord length.

15. A blade according to claim 14 wherein a trailing portion of the periphery is disposed inwardly along the chord line from the leading edge a distance in the range of 40–85 per cent of the chord length.

* * * * *